US005387086A

United States Patent [19]

Frey et al.

[11] Patent Number: 5,387,086

[45] Date of Patent: Feb. 7, 1995

[54] GAS TURBINE BLADE WITH IMPROVED COOLING

[75] Inventors: David A. Frey, West Chester; Mark E. Ulliman, Cincinnati, both of Ohio

[73] Assignee: General Electric Company, Cincinnati, Ohio

[21] Appl. No.: 93,165

[22] Filed: Jul. 19, 1993

[51] Int. Cl.[6] ..... F01D 5/18

[52] U.S. Cl. ..... 416/97 R; 416/96 R

[58] Field of Search ..... 416/95, 96 R, 97 R

[56] References Cited

U.S. PATENT DOCUMENTS

| | | | |
|---|---|---|---|
| 3,533,711 | 10/1970 | Kercher | 416/96 R |
| 4,073,599 | 2/1978 | Allen et al. | 416/96 R |
| 4,162,136 | 7/1979 | Parkes | 416/97 R |
| 4,278,400 | 7/1981 | Yamarik et al. | 416/97 R |
| 4,474,532 | 10/1984 | Pazder | 416/97 R |
| 4,515,526 | 5/1985 | Levengood | 416/96 R |
| 4,775,296 | 10/1988 | Schwarzmann et al. | 416/97 R |
| 4,786,233 | 11/1988 | Shizuya et al. | 416/97 R |
| 4,992,026 | 2/1991 | Ohtomo et al. | 416/97 R |

FOREIGN PATENT DOCUMENTS

| | | | |
|---|---|---|---|
| 0003404 | 1/1985 | Japan | 416/97 R |
| 2250548 | 6/1992 | United Kingdom | 416/95 |

*Primary Examiner*—John T. Kwon

*Assistant Examiner*—Mark Sgantzos

*Attorney, Agent, or Firm*—Jerome C. Squillaro; David L. Narciso

[57] ABSTRACT

A turbine blade is provided which includes an airfoil section having a leading edge flow region and a trailing edge flow region. The leading edge flow region includes an inner cavity having a serpentine geometry and first and second air inlets. The first air inlet is at one end of the inner cavity and is coupled to a first conduit which supplies air coolant thereto. The leading edge flow region also includes a leading edge cavity having a plurality of air film holes at the leading edge of the blade. The leading edge cavity is coupled to the inner cavity by impingement holes therebetween. The leading edge flow region further includes a refresher passageway which connects the first conduit at the base of the blade with the second inlet of the inner cavity. The refresher passageway refreshes the airflow in the inner cavity after the airflow has flowed part way through the inner cavity and has become warmed. The trailing edge flow region includes a trailing edge cavity which is isolated from the inner cavity and which is cooled by air from a second conduit at the base of the blade. The disclosed turbine blade structure advantageously avoids gas ingestion and backflow margin problems.

8 Claims, 1 Drawing Sheet

GAS TURBINE BLADE WITH IMPROVED COOLING

The Government of the United States has rights in this invention pursuant to Contract No. F33657-83-C-0281 awarded by the Department of the Air Force.

BACKGROUND OF THE INVENTION

This invention relates in general to the blades employed in turbo-machinery and, more particularly, to blade structures with improved cooling.

Turbine blades employed in gas turbine engines include a leading edge and a trailing edge. The leading edge is the blade surface which is first contacted by the working medium gases in the turbo-machine. The trailing edge is the blade surface which is last contacted by the working medium gases as they pass by the blade.

The temperatures within turbine engines may exceed 2500 degrees F. and thus cooling of turbine blades becomes very important in terms of engine longevity. Without cooling, turbine blades would rapidly deteriorate. Clearly, improved cooling techniques for turbine blades are very desirable. Conventional turbine blades have internal cavities into which cooling air is pumped to cool the blade. Much effort has been devoted by those skilled in the blade cooling arts to devise improved geometries for the internal cavities within turbine blades in order to enhance cooling.

For example, it is known to use a "cold bridge cooling circuit" to cool a turbine blade. In such a cold bridge cooling circuit, cooling air is supplied directly through an inlet cavity and the cooling air impinges on the leading edge of the blade after minimum heat pickup in the blade airfoil. Unfortunately this cooling technique causes an increase in the temperature difference across the leading edge of the blade. This results in increased thermal stresses in the blade's leading edge which reduces blade life, especially during transient operation where the temperature difference can be amplified.

It is also known to use "warm bridge cooling circuits" to provide cooling to turbine blades. In a warm bridge cooling circuit, the cool inlet air passes through passages in the interior of the blade and warms up as it travels through the passages before impinging on the leading edge of the blade. Advantageously, the temperature difference across the leading edge is much less with this approach. Consequently, lower thermal stresses result in the blade leading edge and the life of the blade is enhanced.

The warm bridge cooling circuit makes efficient use of cooling flow since the flow is able to internally cool the blade over much of the blade mid-span before flowing out radial leading edge cooling holes to film cool the blade airfoil externally. Unfortunately, a major disadvantage of using a warm bridge cooling circuit for this application is "backflow margin". As air flow travels through the internal passages of the blade, pressure losses due to turns and turbulence promoters cause the cooling flow pressure to drop to a level such that gas ingestion into the blade leading edge is no longer reliably preventable. This undesired condition is referred to as backflow. One approach for providing more backflow margin is to increase the inlet pressure of the cooling air which is supplied to the blade. This approach is not always feasible because the increase in supply pressure can increase cooling flow leakages to an undesired level.

SUMMARY OF THE INVENTION

Accordingly, one object of the present invention is to provide a cooled turbine blade which has sufficient backflow margin to prevent gas ingestion.

Another object of the present invention is to provide a cooled turbine blade which avoids backflow margin problems without increasing cooling medium inlet pressure.

Still another object of the present invention is to provide a cooled turbine blade in which thermal stresses are minimized.

Yet another object of the present invention is to provide a turbine blade which is cooled to prevent deterioration thereof.

In accordance with one embodiment of the present invention, a turbine blade structure is provided which includes a base section having first and second cooling medium conduits for providing cooling air, the first and second cooling medium conduits being coupled to first and second air inlet ports respectively. The blade structure includes an airfoil section attached to the base section and further includes a pressure side wall and a suction side wall. The airfoil section includes a leading edge at which the pressure and suction side walls are joined, and further includes an airfoil section having a trailing edge at which the pressure and suction side walls are also joined, thus forming a leading edge flow region and a trailing edge flow region. The airfoil section includes a tip. The airfoil section further includes an inner cavity situated within the leading edge flow region, the inner cavity including a plurality of passageways which together exhibit a serpentine geometry, the inner cavity having an end coupled to the first conduit to receive airflow therefrom, such that cooling air flows from the first conduit toward the leading edge. The airfoil section also includes a leading edge cavity situated adjacent the leading edge and having a plurality of air film holes at the leading edge. The airfoil section further includes a first wall between the inner cavity and the leading edge cavity, the first wall having a plurality of impingement holes for permitting airflow from the inner cavity to the leading edge cavity and to the air film holes, one of the passageways of the inner cavity being designated the passageway closest the leading edge cavity. The airfoil section still further includes a refresher passageway coupling the first conduit to the passageway closest the leading edge cavity to refresh the airflow toward the leading edge in the inner cavity after the airflow has flowed part way through the inner cavity toward the leading edge and has become warmed.

BRIEF DESCRIPTION OF THE DRAWINGS

The features of the invention believed to be novel are specifically set forth in the appended claims. However, the invention itself, both as to its structure and method of operation, may best be understood by referring to the following description and accompanying drawings.

DETAILED DESCRIPTION OF THE INVENTION

Figure 1:
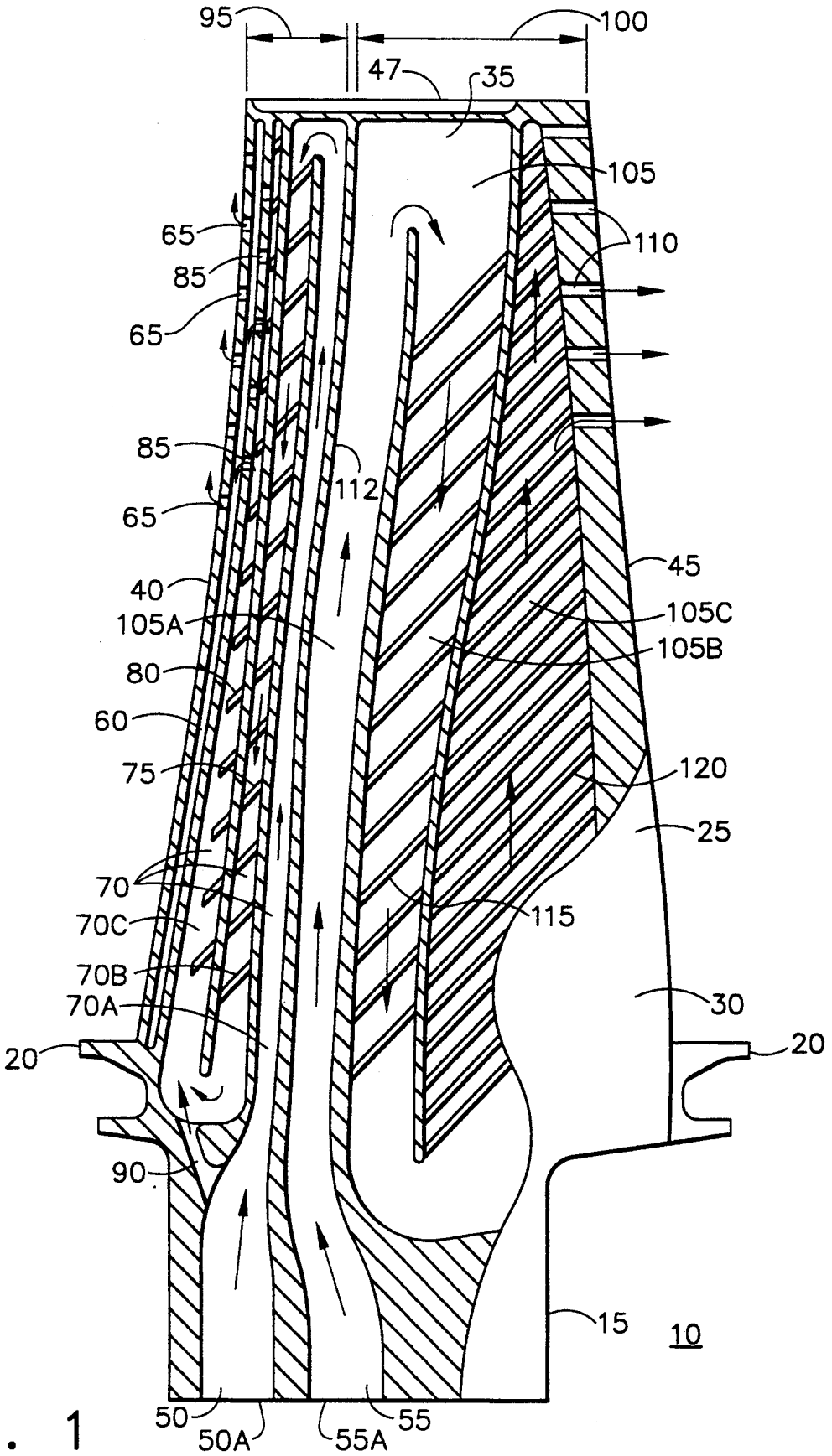
FIG. 1 is a simplified side view of a turbine blade including a cut-away portion which depicts the inner cooling mechanisms of the present invention.

FIG. 1 shows a simplified side view of a turbine blade 10 in which most of the surface of the blade has been cut away to reveal the inner workings of the cooling structures therein. Blade 10 includes a dovetail section 15, a platform section 20 and an airfoil section 25. Dovetail section 15 is adapted for attachment to the rotor of a turbine shaft (not shown) or other turbine blade receiving structure in a gas turbine engine. Platform section 20 forms the portion of the inner wall of the working medium flow path in a turbine engine. Dovetail section 15 and platform section 20 may alternatively be together referred to as the base or base section of turbine blade 10.

Airfoil section 25 extends outwardly into the working medium flow path of the turbine engine where working medium gases can exert motive forces on the surfaces thereof. Airfoil section 25 includes a pressure side wall 30 and a suction side wall 35 which are joined together at leading edge 40 and trailing edge 45. Blade 10 includes a tip 47. For purposes of this document, the inward direction is defined as the direction toward dovetail 15 and the outward direction is defined as the direction toward tip 47.

A leading edge conduit 50 and a trailing edge conduit 55 provide supplies of pressurized cooling air to blade 10. An air inlet port 50A or opening is situated at the lowermost end of leading edge conduit 50 as shown in FIG. 1. An air inlet port 55A or opening is situated at the lowermost end of trailing edge conduit 55 also as shown in FIG. 1. Blade 10 includes a leading edge cavity 60 having a plurality of film air holes 65. Blade 10 also includes an inner cavity 70 which is coupled to leading edge conduit 50. Inner cavity 70 is a three pass serpentine which includes a passageway 70A, a passageway 70B and a passageway 70C. Cooling air flows outwardly from leading edge conduit 50 and along passageway 70A, and then turns inwardly into passageway 70B along which a plurality of turbulence promoters 75 are situated. Such turbulence promoters increase the effective heat transfer efficiency where they are located. The air then turns outwardly into passageway 70C along which turbulence promoters 80 are also situated. As cooling air flows along passageways 70A, 70B and 70C, it convectively cools the portions of turbine blade 10 adjacent these passageways throughout leading edge flow region 95.

As the pressurized air passes into passageway 70C of inner cavity 70, it flows through connecting holes or impingement holes 85 which couple inner cavity 70 to leading edge cavity 60. Leading edge cavity 60 is thus pressurized and cooling air flows out film cooling holes 65 to create an air film on the exterior of leading edge 40. In this manner, the exterior of leading edge 40 is film-cooled.

Blade 10 is equipped with a refresher air passageway 90 which directly couples coolant air from conduit 50 to passageway 70C, which is the passageway of inner cavity 70 closest to leading edge cavity 60. Refresher passageway 90 is situated adjacent platform section 20 and/or dovetail section 15, as shown. In this manner the air which has passed through passageways 70A and 70B, and which has become warmed, is refreshed with cool air. This provides sufficient pressure in passageway 70C to prevent backflow problems and enhances cooling in the leading edge of blade 10.

Leading edge cavity 60, serpentine inner cavity 70 and refresher passageway 90 together form an advanced type of modified warm bridge cooling circuit for the leading edge flow region 95 of blade 10 in which backflow problems are substantially reduced.

To cool the trailing edge flow region 100 of blade 10, trailing edge flow region 100 is provided with a trailing edge cavity 105 having a plurality of air exit slots 110 at trailing edge 45. Trailing edge cavity 105 is coupled to trailing edge air conduit 55 such that cavity 105 is supplied with cooling air. As seen in FIG. 1, trailing edge cavity 105 is isolated from inner cavity 70 by an inner wall 112 therebetween. Trailing edge cavity 105 includes serpentine passageways 105A, 105B and 105C. More particularly, passageway 105A is coupled to trailing edge air conduit 55 such that pressurized air passes outwardly through passageway 105A and then turns inwardly into passageway 105B. Passageway 105B includes a plurality of turbulence promoters 115 along its path. After passing through passageway 105B, the air turns and passes outwardly through passageway 105C which includes a plurality of turbulence promoters 120 along its path. After cooling the trailing edge flow region 100 along passageways 105A, 105B and 105C, the air exits exit slots 110 as shown.

In summary, an advanced cooling structure has been provided to cool both the leading edge flow region 95 and the trailing edge flow region 100 of blade 10. Refresher passageway 90 brings a percentage of the leading edge supply air from the dovetail section 15 (conduit 50) directly into inner cavity 70. Refresher passageway 90 effectively "short circuits" the modified warm bridge serpentine of inner cavity 70, and mixes relatively cool higher pressure air from the dovetail section with warmer lower pressure air from the serpentine inner cavity 70. The additional air flow provided by refresher passageway 90 increases the cooling pressure in inner cavity 70 which results in a corresponding increase in leading edge backflow margin. The resulting increase in temperature difference across the leading edge cavity with the present invention is lower than that for a cold bridge circuit. This improved condition lessens leading edge thermal stresses and thereby increases turbine blade life.

The foregoing has described a cooled turbine blade which has sufficient backflow margin to prevent gas ingestion. The disclosed turbine blade avoids backflow margin problems without increasing cooling medium inlet pressure. Moreover, the disclose turbine blade desirably minimizes thermal stresses in the blade which, in turn, slows the process of blade deterioration.

While only certain preferred features of the invention have been shown by way of illustration, many modifications and changes will occur to those skilled in the art. It is, therefore, to be understood that the present claims are intended to cover all such modifications and changes which fall within the true spirit of the invention.

What is claimed is:

1. A turbine blade structure comprising:

a base section including first and second cooling medium conduits for providing cooling air, said first and second cooling medium conduits being coupled to first and second air inlet ports respectively;

an airfoil section attached to said base section and including a pressure side wall and a suction side wall, said airfoil section including a leading edge at which said pressure and suction side walls are joined, said airfoil section including a trailing edge at which said pressure and suction side walls are also joined, thus forming a leading edge flow region and a trailing edge flow region, said airfoil section having a tip and further including:

an inner cavity situated within said leading edge flow region, said inner cavity including a plurality of passageways which together exhibit a serpentine geometry, said inner cavity having an end coupled to said first conduit to receive airflow therefrom, such that cooling air flows from said first conduit toward said leading edge;

a leading edge cavity situated adjacent said leading edge and including a plurality of air film holes at said leading edge; a first wall between said inner cavity and said leading edge cavity, said first wall including a plurality of impingement holes for permitting airflow from said inner cavity to said leading edge cavity and to said air film holes, one of the passageways of the inner cavity being designated the passageway closest the leading edge cavity, and a refresher passageway coupling said first conduit to said passageway closest the leading edge cavity to refresh the airflow toward said leading edge in said inner cavity after said airflow has flowed part way through said inner cavity toward said leading edge and has become warmed.

2. The turbine blade structure of claim 1 further comprising a trailing edge cavity within said airfoil section at said trailing edge flow region, said trailing edge cavity being coupled to said second conduit to receive airflow therefrom, said trailing edge cavity including a plurality of air exit apertures.

3. The turbine blade structure of claim 2 further comprising a second wall situated between said trailing edge cavity and said inner cavity to isolate said trailing edge cavity from said inner cavity.

4. The turbine blade structure of claim 1 wherein said inner cavity includes a first passageway having base and tip ends, the base end of said first passageway being coupled to said first conduit;

a second passageway having base and tip ends, the tip end of said second passageway being coupled to the tip end of said first passageway, and a third passageway having base and tip ends, the base end of said third passageway being coupled to the base end of said second passageway, said third passageway being situated along said first wall so as to supply air to said leading edge cavity though the connective holes in said first wall, said third passageway being said passageway closest the leading edge cavity.

5. The turbine blade structure of claim 4 wherein said second passageway includes a plurality of turbulence promoters.

6. The turbine blade structure of claim 4 wherein said third passageway includes a plurality of turbulence promoters.

7. The turbine blade structure of claim 1 wherein said trailing edge cavity exhibits a serpentine geometry.

8. The turbine blade structure of claim 2 wherein said trailing edge cavity includes a plurality of turbulence promoters.

* * * * *